US006700325B2

(12) United States Patent
Amatsuchi

(10) Patent No.: US 6,700,325 B2
(45) Date of Patent: Mar. 2, 2004

(54) PLASMA DISPLAY PANEL

(75) Inventor: Mario Amatsuchi, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 0 days.

(21) Appl. No.: 10/247,335

(22) Filed: Sep. 20, 2002

(65) Prior Publication Data

US 2003/0146700 A1 Aug. 7, 2003

(30) Foreign Application Priority Data

Feb. 7, 2002 (JP) ..... 2002-30297

(51) Int. Cl.[7] ..... H01J 17/49
(52) U.S. Cl. ..... 313/587; 313/585; 313/586
(58) Field of Search ..... 313/584–587; 315/169.4; 345/41, 55, 60

(56) References Cited

U.S. PATENT DOCUMENTS 6,465,956 B1 * 10/2002 Koshio et al. ..... 313/586
6,512,330 B2 * 1/2003 Nakajima et al. ..... 313/586
6,614,183 B2 * 9/2003 Masuda et al. ..... 313/586

* cited by examiner

*Primary Examiner*—Ashok Patel
(74) *Attorney, Agent, or Firm*—Arent Fox Kintner Plotkin & Kahn

(57) ABSTRACT

A recessed groove h is formed in a portion of an inner surface of a front glass substrate 10 facing a non-display area between adjacent discharge cells C in a column direction. Each of adjacent bus electrodes Xb and Yb of the respective row electrodes X and Y positioned back to back in between the adjacent row electrode pairs (X, Y) is formed to extend along the corresponding side face of the two side faces of the recessed groove h in such a way as to raise the bus electrode in relation to the corresponding transparent electrode Xa or Ya in a thickness direction of the front glass substrate 10.

6 Claims, 5 Drawing Sheets

V1-V1 SECTION

W1-W1 SECTION

V-V SECTION

W-W SECTION

PLASMA DISPLAY PANEL

BACKGROUND OF THE INVENTION

1. Field of the Invention

This invention relates to a panel structure of a surface-discharge-type alternating-current plasma display panel.

The present application claims priority from Japanese Application No. 2002-30297, the disclosure of which is incorporated herein by reference for all purposes.

2. Description of the Related Art

At the present time, AC matrix plasma display panels using a gas discharge for producing light emission (hereinafter referred to as "PDP") have been released on the market as an oversized and slim display for color screen, and attempts have also been made to become commonly used in ordinary homes and the like.

FIG. 6 to FIG. 8 are schematic views of a conventional construction of the surface-discharge-type alternating-current plasma display panel. FIG. 6 is a front view of the conventional surface-discharge-type AC plasma display panel. FIG. 7 is a sectional view taken along the V—V line of FIG. 6. FIG. 8 is a sectional view taken along the W—W line of FIG. 6.

In FIGS. 6 to 8, the plasma display panel (hereinafter referred to as "PDP") includes a front glass substrate 1, serving as the display surface of the PDP, having on its back surface, in order, a plurality of row electrode pairs (X', Y'), a dielectric layer 2 covering the row electrode pairs (X', Y'), and a protective layer 3 made of MgO and covering the back surfaces of the dielectric layer 2.

Each of the row electrodes X', Y' is constructed of a transparent electrode Xa', Ya' which is formed of a transparent conductive film with a larger width made of ITO or the like, and a bus electrode Xb', Yb' which is formed of a metal film with a smaller width assisting the electrical conductivity of the corresponding transparent electrode.

The row electrodes X' and Y' are arranged in alternate positions in the column direction such that the electrodes X' and Y' of each pair (X', Y') face each other with a discharge gap g' in between. Each of the row electrode pairs (X', Y') forms a display line (row) L in the matrix display.

The front glass substrate 1 is situated opposite a back glass substrate 4 with a discharge-gas-filled discharge space S' interposed between the substrates 1 and 4. The back glass substrate 4 is provided thereon with: a plurality of column electrodes D' which are arranged in parallel to each other and each extend in a direction at right angles to the row electrode pair (X', Y'); band-shaped partition walls 5 each extending in parallel to and between adjacent column electrodes D'; and phosphor layers 6 formed of phosphor materials of a red color, green color, and blue color, each of which covers the side faces of adjacent partition walls 5 and the column electrode D'.

In each display line L, the partition walls 5 partition the discharge space S' into areas each corresponding to an intersection of the column electrode D' and the row electrode pair (X', Y'), to define discharge cells C' which are unit light-emitting areas.

Such surface-discharge-type alternating-current PDP generates images through the following procedure.

First, in an addressing period following a reset period for carrying out a reset discharge, a discharge (an addressing discharge) is selectively caused between one row electrode of each electrode pair (X', Y') (the row electrode Y' in this example) and the column electrode D' in each of the discharge cells C'. As a result of the addressing discharge, lighted cells (the discharge cell in which wall charges are generated on the dielectric layer 2) and non-lighted cells (the discharge cell in which wall charges are not generated on the dielectric layer 2) are distributed over the panel surface in accordance with an image to be displayed.

After completion of the addressing period, a discharge sustaining pulse is applied alternately to the row electrodes X' and Y' of each row electrode pair simultaneously in each display line L. Every time the discharge sustaining pulse is applied, a discharge (a sustaining discharge) is caused between the row electrodes X' and Y' in each lighted cell by the wall charges generated on the dielectric layer 2.

Ultraviolet light is generated by the sustaining discharge in each lighted cell, which then excites the red, green or blue phosphor layer 6 in each discharge cell C' to thereby form a display image.

In the conventional three-electrode surface-discharge-type alternating-current PDP having an arrangement of the row electrodes X' and Y' in alternate positions in the column direction as described above, a potential difference is produced between the back-to-back positioned row electrodes X' and Y' (between the back-to-back bus electrodes Xb' and Yb') of the respective row electrode pairs (X', Y') adjacent to each other when the PDP is driven, and capacitance occurs in the non-display area between the back-to-back positioned row electrodes X' and Y'.

The potential difference produced between the back-to-back positioned bus electrodes Xb' and Yb' in this manner becomes a cause of creating an undesired surface discharge between the bus electrodes Xb' and Yb'. Further, the capacitance formed in the non-display area between the corresponding display lines L becomes a cause of an increase of unnecessary power consumption.

In order to reduce such unnecessary power consumption which occurs in the non-display area between adjacent display lines L, making sufficient spacing between the back-to-back bus electrodes Xb' and Yb' is needed.

However, increasing the spacing between the back-to-back bus electrodes Xb' and Yb' results in an increase in area of the non-display area in the established entire display area of the PDP.

Accordingly, maintaining the same number of display lines L produces a problem of a reduction in brightness because of a decrease in area of the opening of each discharge cell C' by an increased amount of area of the non-display area, whereas maintaining the area of an opening of each discharge cell C' produces another problem of impossibility of increasing an image definition because the number of display lines L is decreased.

SUMMARY OF THE INVENTION

The present invention has been made to solve the above problems associated with the prior art surface-discharge-type alternating-current plasma display panels.

Accordingly, it is an object of the present invention to provide a surface-discharge-type alternating-current plasma display panel which is capable of reducing unnecessary power consumption occurring in a non-display area between adjacent display lines without a reduction in the number of display lines and in brightness.

To attain this object, according to a first feature of the present invention, a plasma display panel including: a pair of substrates opposite each other with an interposed discharge space; a plurality of row electrode pairs provided on an inner surface of one substrate of the pair of the substrates, arranged in a column direction and each extending in a row direction to form a display line; a dielectric layer covering the row electrode pairs on the inner surface of the one substrate; and a plurality of column electrodes provided on a surface of the other substrate facing the one substrate, arranged in the row direction, and each extending in the column direction to intersect the row electrode pairs and form unit light-emitting areas in the discharge space at the respective intersections, the plasma display panel comprises: a recess provided in a portion of the inner surface of the one substrate facing a non-display area between the adjacent unit light-emitting areas in the column direction, wherein each of row electrodes constituting each of the row electrode pairs comprises an edge portion, and the adjacent edge portions of the respective row electrodes positioned back to back in between the adjacent row electrode pairs respectively extend along both side faces of each of the recesses, formed in the one substrate, in a direction of raising the edge portions in relation to other portions of the respective row electrodes concerned in a thickness direction of the one substrate.

In the plasma display panel according to the first feature, the edge portion of each of the row electrodes constituting the row electrode pair is formed to extend along a side face of the recess within each of the recesses, formed in the inner surface of one of the substrate with the row electrode pairs formed thereon, in such a way as to raise the edge portion in relation to another portion of the row electrode concerned in a thickness direction of the one substrate. Hence, spacing between the edge portions of the respective row electrodes adjacent to each other with the interposed recess is increased by a surplus area created by providing the edge portion of the row electrode in the raised position, as compared with the prior art PDPs having the same number of display lines and the same opening area of the unit light-emitting area as those in the PDP of the present invention.

Therefore, after completion of an addressing discharge produced between the column electrode and one row electrode of the row electrode pair, a discharge sustaining pulse is applied alternately to the row electrodes of the row electrode pair to cause a sustaining discharge between the row electrodes. In this sustaining discharge, if even a potential difference is produced between the row electrodes positioned back to back in between the adjacent row electrode pairs, a discharge is prevented from occurring between the adjacent edge portions of the respective row electrodes concerned and also capacitance between the edge portions concerned is decreased, because of the adequately opened spacing between the edge portions concerned.

According to the first feature, the present invention allows prevention of occurrence of undesired power consumption without a reduction in the number of display lines and in the area of an opening of each unit light-emitting area.

Further, when the spacing between the edge portions of the back-to-back positioned row electrodes is established to be equal to that in the prior art PDPs, it is possible to reduce a pitch of the spacing between the display lines to increase the number of display lines for higher image definition and also to increase the area of the opening of each unit light-emitting area to increase image brightness.

To attain the aforementioned object, the plasma display panel according to the present invention has, in addition to the configuration of the first feature, a second feature that each of the row electrodes constituting each of the row electrode pairs comprises an electrode body extending in the row direction and forming the edge portion, and transparent electrodes each extending from the electrode body in the column direction to face the other row electrode of the paired row electrodes with an interposed discharge gap, and that the electrode body extends along one of the both side faces of the recess in a direction of raising the electrode body in relation to the corresponding transparent electrode in a thickness direction of the one substrate.

In the plasma display panel according to the second feature, the electrode body of the row electrode is formed to extend along a side face of the recess within the recess formed in the inner surface of the one substrate in such a way as to raise the electrode body in relation to the corresponding transparent electrode of the row electrode in the thickness direction of the one substrate. Hence, the spacing between the adjacent electrode bodies of the respective row electrodes positioned back to back in between the adjacent row electrode pairs is increased as compared with the prior art PDPs.

Due to this design, if even a potential difference is produced between the electrode bodies positioned back to back in between the adjacent row electrode pairs when a sustaining discharge is caused, a discharge is prevented from occurring between the electrode bodies concerned. Additionally, capacitance between the electrode bodies concerned is decreased, thereby preventing occurrence of undesired power consumption.

To attain the aforementioned object, the plasma display panel according to the present invention has, in addition to the configuration of the first feature, a third feature of further comprising a middle layer provided on a portion of the inner surface of the one substrate facing each of the unit light-emitting areas to be interposed between the one substrate and the dielectric layer, wherein each of the recesses is configured by a space between the middle layers adjacent to each other in the column direction, and each of the row electrode pairs is formed on the middle layer.

According to the third feature, the middle layer is formed on a portion of the inner surface of the one substrate facing each of the unit light-emitting areas by means of the patterned coating of a photosensitive glass paste by the use of photolithographic techniques or the like, for example. Then, the row electrode pair and the dielectric layer are formed on the middle layer.

Between the adjacent middle layers in the column direction, the recess is formed to face the non-light emitting area, and the edge portion of the row electrode is formed to extend along the side face of the recess in such a way as to the edge portion in relation to another portion of the row electrode concerned in the thickness direction of the one substrate.

To attain the aforementioned object, the plasma display panel according to the present invention has, in addition to the configuration of the first feature, a fourth feature that the recess is formed by partially cutting the inner surface of the one substrate.

According to the fourth feature, the inner surface of the one substrate is cut at portions each facing the non-display area between the adjacent unit light-emitting areas in the column direction to form the recesses.

Each of the row electrode pairs is formed on the portion of the inner surface of the one substrate facing each unit light-emitting area. Each of the adjacent edge portions of the respective row electrodes positioned back to back in between the adjacent row electrode pairs in the column direction extends along the side face of the recess in such a way as to raise the edge portion in relation to another portion of the same row electrode in the thickness direction of the one substrate.

To attain the aforementioned object, the plasma display panel according to the present invention has, in addition to the configuration of the first feature, a fifth feature that the both side faces of the recess extend in a direction approximately perpendicular to the one substrate.

According to the fifth feature, each of the side faces of the recess is formed to extend in a direction approximately perpendicular to the one substrate. That is to say, the recess is shaped to be approximately rectangular in cross section. Then, the edge portion of one row electrode adjacent to another row electrode of a different row electrode pair is formed to extend along one of the inner side faces of the recess which is parallel to the thickness direction of the one substrate. Thus, a mounting area of the edge portion of the row electrode when viewed from the surface of the one substrate on the display surface side is further decreased, so that the spacing between the edge portions of the back-to-back row electrodes is increased by a decreased area of the mounting area.

With such design, the effectiveness of prevention of a discharge from occurring in the non-display area is enhanced. Additionally, capacitance between the edge portions of the back-to-back row electrodes is also decreased much more, leading to effective prevention of occurrence of undesired power consumption.

To attain the aforementioned object, the plasma display panel according to the present invention has, in addition to the configuration of the first feature, a sixth feature that the side faces of both sides of the recess respectively extend along indented faces of the one substrate in a wedge-like form.

According to the sixth feature, the recess has the two side faces formed in a configuration resulting from indenting the one substrate in wedge-like form. In other words, the recess is shaped to be approximately trapezoidal in cross section so as to gradually increase in width toward the top of the trapezoid. Accordingly, the spacing between the adjacent edge portions of the respective row electrodes formed along the corresponding side faces of the recess increases gradually toward the top of the recess. This design improves the effectiveness of prevention of occurrence of a discharge in the non-display area, and also a further decrease in capacitance between the edge portions of the back-to-back row electrodes, leading to more effective prevention of unnecessary power consumption.

These and other objects and features of the present invention will become more apparent from the following detailed description with reference to the accompanying drawings.

DETAILED DESCRIPTION OF THE PREFERRED EMBODIMENT

Preferred embodiments according to the present invention will be described hereinafter in detail with reference to the accompanying drawings.

Figure 1:
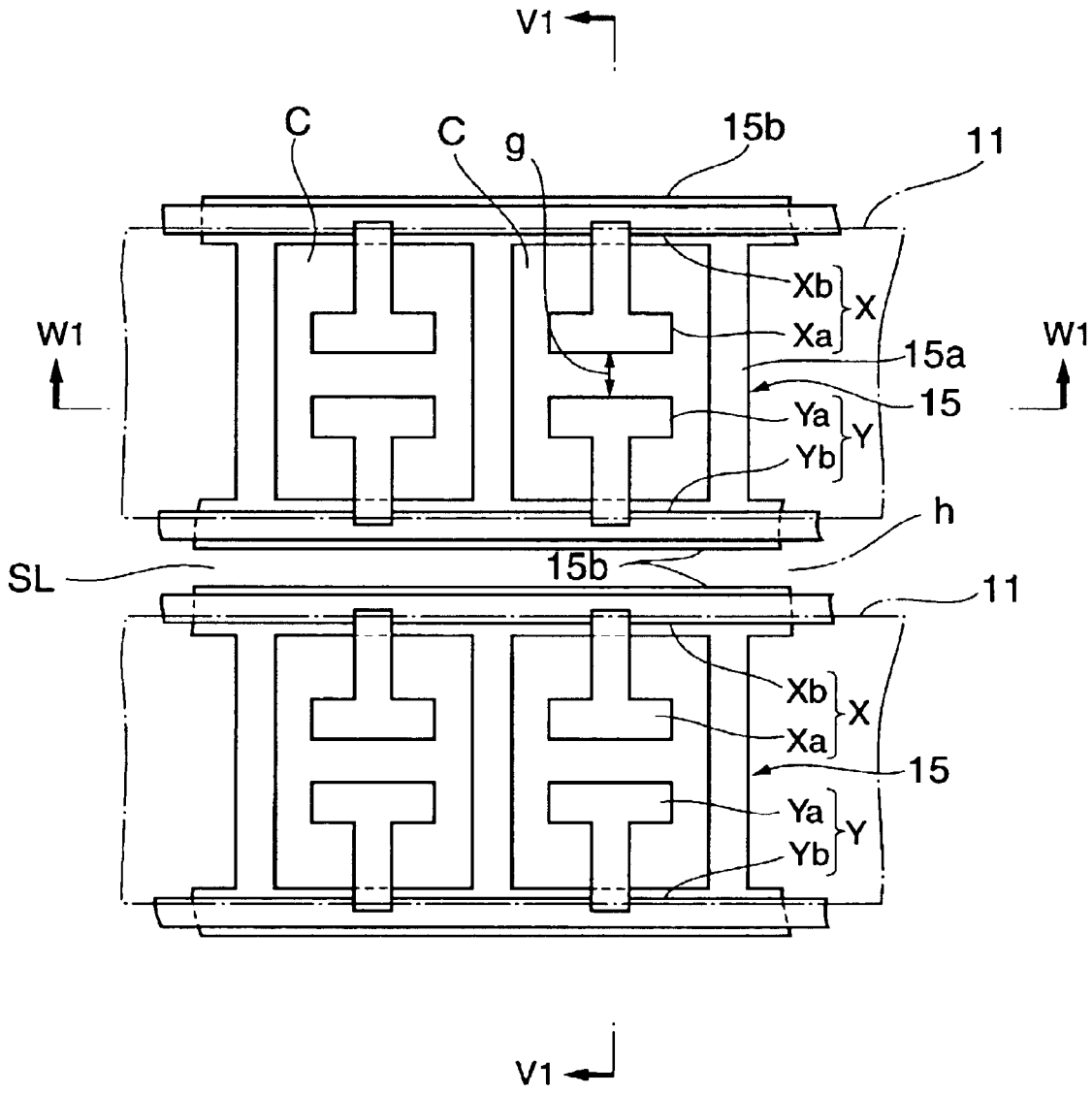
FIG. 1 is a plan view schematically illustrating a first embodiment according to the present invention.
Figure 2:
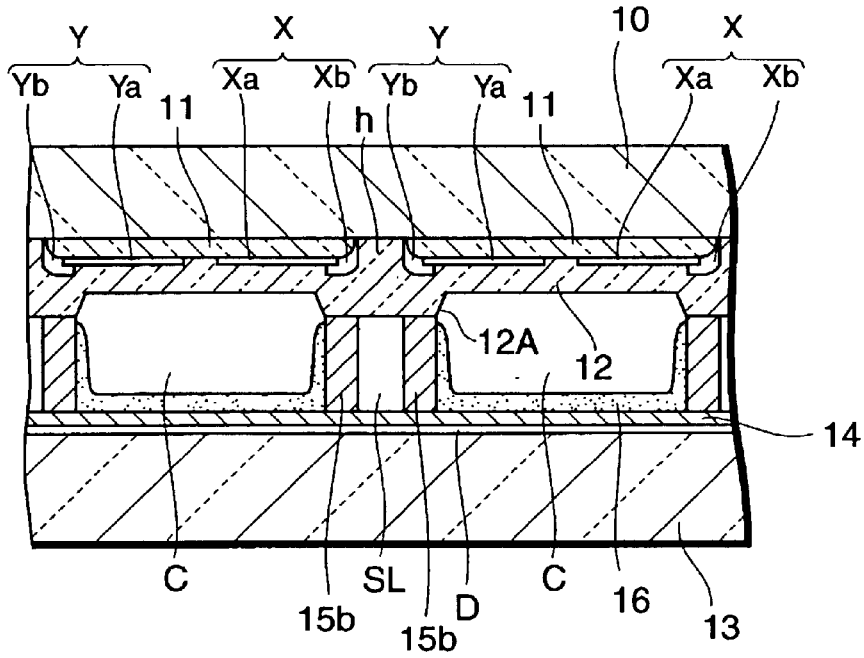
FIG. 2 is a sectional view taken along the V1—V1 line of FIG. 1.
Figure 3:
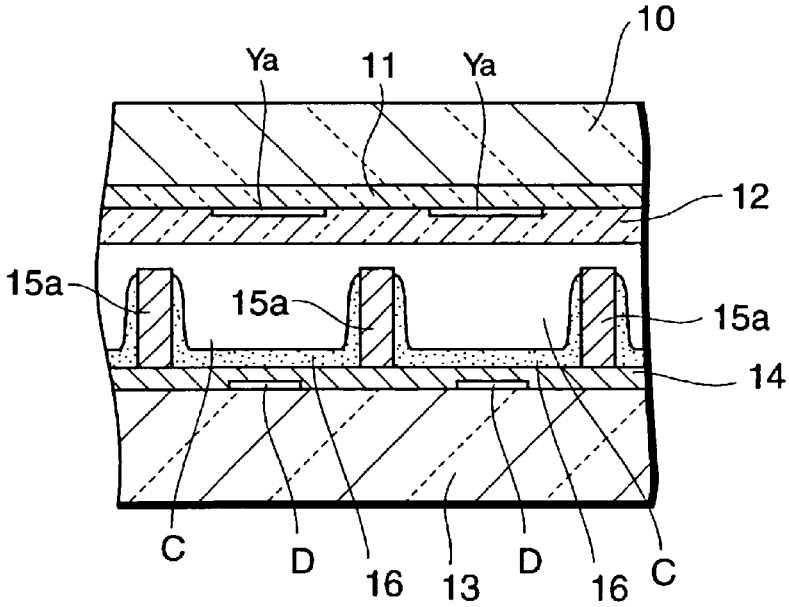
FIG. 3 is a sectional view taken along the W1—W1 line of FIG. 1.

FIG. 1 to FIG. 3 illustrate a first embodiment of a plasma display panel (hereinafter referred to as "PDP") according to the present invention. FIG. 1 is a schematic plan view of the PDP in the first embodiment. FIG. 2 is a sectional view taken along the V1—V1 line of FIG. 1. FIG. 3 is a sectional view taken along the W1—W1 line of FIG. 1.

In FIGS. 1 to 3, a plurality of middle glass substrates 11 having a band-like shape extending in the row direction are arranged in parallel to each other at required intervals in the column direction (the vertical direction in FIG. 1) on the back surface of a front glass substrate 10 which is a display surface. Each of the substrates 11 faces discharge cells C described later.

To form the middle glass substrate 11, a photosensitive glass paste is coated on the back surface of the front glass substrate 10 and then patterned by use of photolithographic techniques.

On the back surface of each of the middle glass substrates 11, a row electrode pair (X, Y) is placed in parallel to the adjacent row electrode pairs (X, Y) so as to extend in the row direction of the front glass substrate 10 (the right-left direction of FIG. 1). The row electrodes X and Y of each pair form a display line (row) in matrix display.

Each of the row electrodes X includes transparent electrodes Xa each of which is formed of a transparent conductive film made of ITO or the like constructed in a letter-T shape, and a bus electrode Xb which is formed of a metal film extending in the row direction of the front glass substrate 10 and connected to a narrowed base end of each of the transparent electrodes Xa.

Each of the transparent electrode Xa extends from one edge (right edge in FIG. 2) of the middle glass substrate 11 toward the center of the substrate 11. The bus electrode Xb extends along the one edge (right edge in FIG. 2) of the middle glass substrate 11 while an outer edge portion of the electrode Xb is placed into a recessed groove h which extends in the row direction between adjacent middle glass substrates 11.

Likewise, each of the row electrodes Y includes transparent electrodes Ya each of which is formed of a transparent conductive film made of ITO or the like constructed in a letter-T shape, and a bus electrode Yb which is formed of a metal film extending in the row direction of the front glass substrate 10 and connected to a narrowed base end of each of the transparent electrodes Ya.

Each of the transparent electrode Ya extends from the other edge (left edge in FIG. 2) of the middle glass substrate 11 toward the center of the substrate 11. The bus electrode Yb extends along the other edge (left edge in FIG. 2) of the middle glass substrate 11 while an outer edge of the electrode Yb is placed into the recessed groove h.

In each row electrode pair (X, Y), the transparent electrodes Xa and Ya are arranged along the corresponding bus electrodes Xb and Yb at regular intervals. The transparent electrodes Xa and Ya paired extend toward each other such that leading ends of widened portions of the respective electrodes Xa and Ya are opposite each other with an interposed discharge gap g having a required width.

Each of the bus electrodes Xb and Yb is designed to be partially placed in the recessed groove h to extend along a side face of the middle glass substrate 11 in such a way as to raise the bus electrode in relation to the corresponding transparent electrode in a thickness direction of the front glass substrate 10 (the vertical direction in FIG. 2). Accordingly, the back-to-back bus electrodes Xb and Yb of the respective row electrode pairs (X, Y) adjacent to each other are opposite each other within the recessed groove h provided between the middle glass substrates 11.

On the back surfaces of the front glass substrate 10 and the middle glass substrate 11, a dielectric layer 12 is formed to cover the row electrode pairs (X, Y). On the back surface of the dielectric layer 12, an additional dielectric layer 12A having a required width extends in the row direction in a position opposite to back-to-back bus electrodes Xb and Yb and the corresponding recessed groove h.

It should be noted that a protective layer made of MgO (not shown) is also provided.

The front glass substrate 10 is situated in parallel to a back glass substrate 13 having a surface facing toward the display surface on which a plurality of column electrodes D are arranged in parallel to each other at predetermined intervals and each extend in a direction at right angles to the bus electrode pairs (X, Y) (the column direction) in a position opposite to the paired transparent electrodes Xa and Ya of the row electrode pairs (X, Y).

On the surface of the back glass substrate 13 on the display surface side, a column-electrode protective layer 14 is formed to cover the column electrodes D, and partition walls 15 are formed on the column-electrode protective layer 14.

The partition wall 15 is constructed in ladder-shaped pattern by vertical walls 15*a* each extending in the column direction in a position between adjacent column electrodes D arranged in parallel; and transverse walls 15*b* each extending in the row direction in a position opposite the bus electrode Xb or Yb of the row electrode X or Y. The ladder-patterned partition walls 15 partition the discharge space defined between the front and back glass substrates 10 and 13 into quadrangular sections each corresponding to the paired transparent electrodes Xa and Ya of each row electrode pair (X, Y) to define the discharge cells C arranged in matrix.

The ladder-patterned partition walls 15 are arranged such that the back-to-back positioned transverse walls 15*b* of adjacent partition walls 15 are separated from each other to form an interstice SL extending in the row direction therebetween.

A leading end-face of each transverse wall 15*b* of the partition wall 15 is in contact with a back surface of the additional dielectric layer 12A.

A phosphor layer 16 is provided to cover five faces facing each discharge cell C: a face of the column-electrode dielectric layer 14 and the four inner side faces of the vertical walls 15*a* and transverse walls 15*b* of the partition wall. The phosphor layers 16 are arranged in order a red color, a green color and a blue color along the row direction for each discharge cell C.

The discharge cell C is filled with a discharge gas.

In the PDP according to the first embodiment, an addressing discharge is caused between one row electrode of each electrode pair (X, Y) and the column electrode D. Then, a discharge sustaining pulse is applied alternately to the row electrodes X and Y of each row electrode pair (X, Y) to cause a sustaining discharge between the row electrodes X and Y in each discharge cell C in which wall charges are generated on the dielectric layer 12 by the addressing discharge (i.e. the lighted cell). As a result, the phosphor layer 16 emits light in each lighted cell to form an image on the panel face in accordance with a video signal.

Concerning the above PDP, each of the bus electrodes Xb and Yb of the row electrodes X and Y which are positioned back to back in between adjacent row electrode pairs (X, Y) is placed in the recessed groove h to extend along the edge face of the middle glass substrate 11 in such a way as to raise the bus electrode in relation to the corresponding transparent electrode in a direction perpendicular to the front glass substrate 10. Hence, spacing between the bus electrodes Xb and Yb positioned back to back with the interposed recessed groove h is increased by a surplus area created by placing the bus electrodes Xb and Yb in its raised position, as compared with cases of the prior art PDPs having the same number of display lines L and the same area of an opening of each discharge cell C as those in the present invention.

Due to the increased spacing, when the sustaining discharge is caused, if a potential difference is produced between the bus electrodes Xb and Yb positioned back to back in between the adjacent row electrode pairs (X, Y), a discharge is prevented from occurring between the bus electrodes Xb and Yb concerned. Additionally, capacitance between the bus electrodes Xb and Yb concerned is also decreased. Thus, it is possible to prevent unnecessary power consumption without a reduction in the number of display lines and in the area of opening of the discharge cell.

Further, if the spacing between back-to-back positioned bus electrodes Xb and Yb is determined equally to that in the prior art PDP, the present invention permits a decrease of the pitch of the spacing between display lines to increase the number of display lines for higher image definition, and an increase of the area of the opening of the discharge cell to increase brightness of an image.

Figure 4:
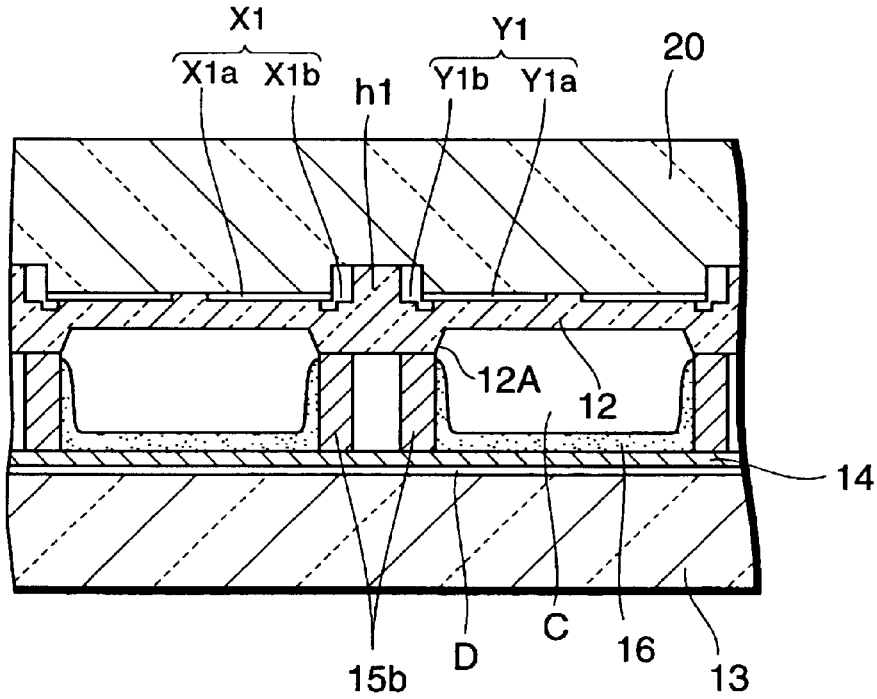
FIG. 4 is a sectional side view illustrating a second embodiment according to the present invention.

FIG. 4 is a sectional side view illustrating a second embodiment of the PDP according to the present invention, which is taken in the same position as that in FIG. 2 of the first embodiment.

The PDP of the second embodiment includes a recessed groove h1 with a rectangular cross-section which is formed in a portion of the back surface of a front glass substrate 20 opposite to back-to-back transverse walls 15*b* of the adjacent partition walls 15 and the interstice SL between the back-to-back transverse walls 15*b* by use of sandblast technique and extends in a band form in the row direction.

Each of bus electrodes X1*b*, Y1*b* of row electrodes X1, Y1 extends along an inner side face of the recessed groove h1 in parallel to the thickness direction of the front glass substrate 20 (i.e., in a vertical direction in relation to the corresponding transparent electrode X1*a* or Y1*a*).

Other configuration of the PDP in the second embodiment is approximately the same as that in the first embodiment, and the same reference numerals as those in the first embodiment are used in FIG. 4.

In the PDP of the second embodiment, the recessed groove h1 is rectangular in cross section. Each of the bus electrodes X1*b*, Y1*b* is formed to extend along the inner side face of the recessed groove h1 which is parallel to the thickness direction of the front glass substrate 20. Hence, a mounting area for the bus electrodes X1*b* and Y1*b* when viewed from the display surface of the front glass substrate 20 is decreased much more than the case of the first example, so that the spacing between the bus back-to-back electrodes X1*b* and Y1*b* is increased correspondingly.

Such design according to the second embodiment improves the effectiveness of prevention of an opposite discharge occurring between bus discharges X1*b* and Y1*b* positioned back to back in between the adjacent row electrode pairs (X1, Y1). Additionally, capacitance between the bus electrodes X1*b* and Y1*b* concerned is also decreased much more, leading to prevention of unnecessary power consumption.

Further, the second embodiment makes it possible to increase the number of display lines for higher image definition, and increase the area of opening of the discharge cell for an increase in brightness of an image.

Figure 5:
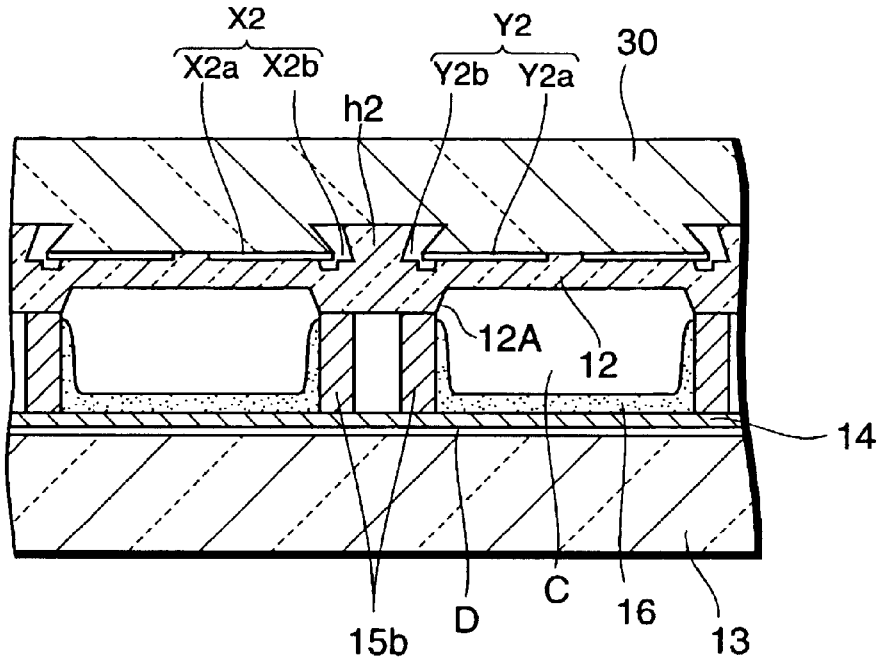
FIG. 5 is a sectional side view illustrating a third embodiment according to the present invention.
Figure 6:
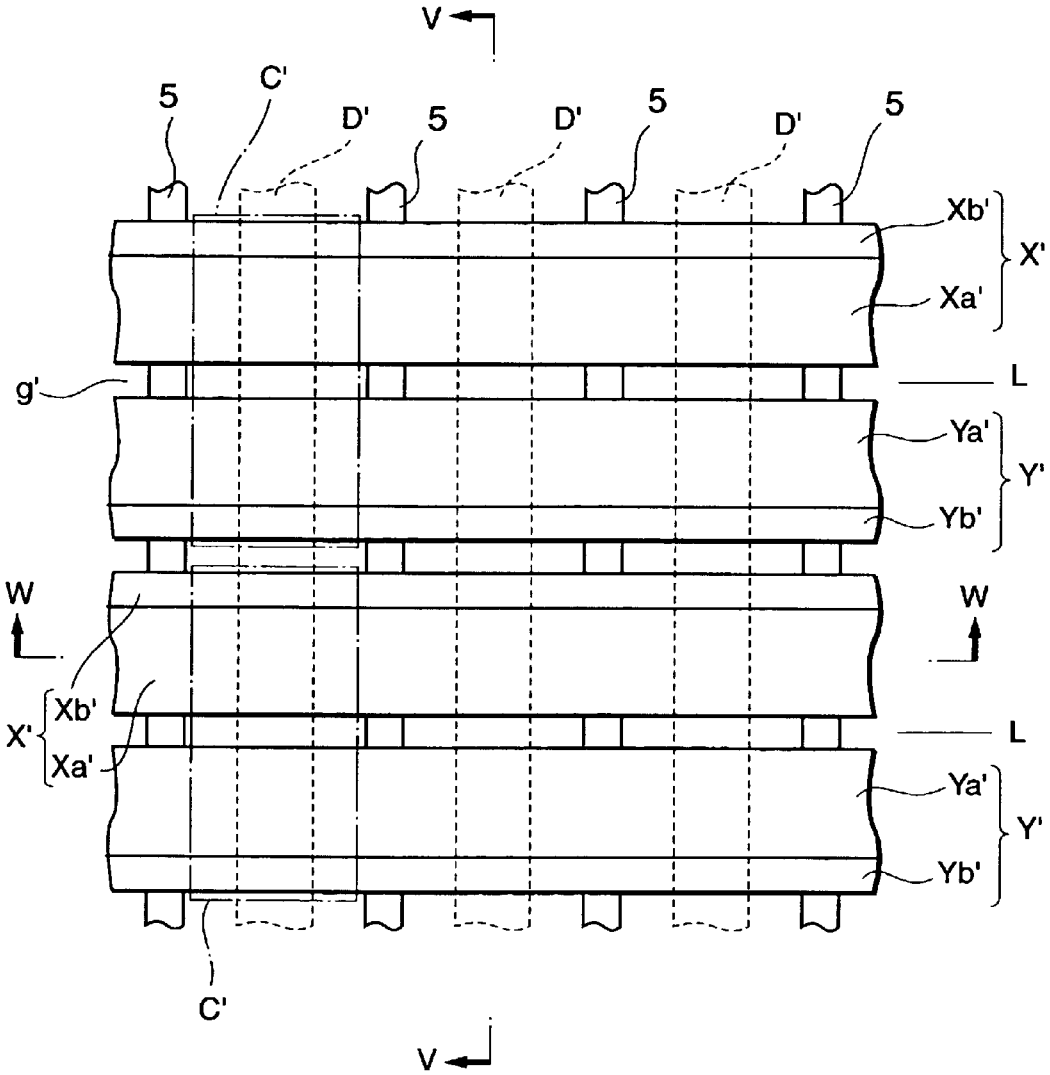
FIG.6 PRIOR ART
FIG. 6 is a plan view schematically illustrating a prior art PDP.
Figure 7:
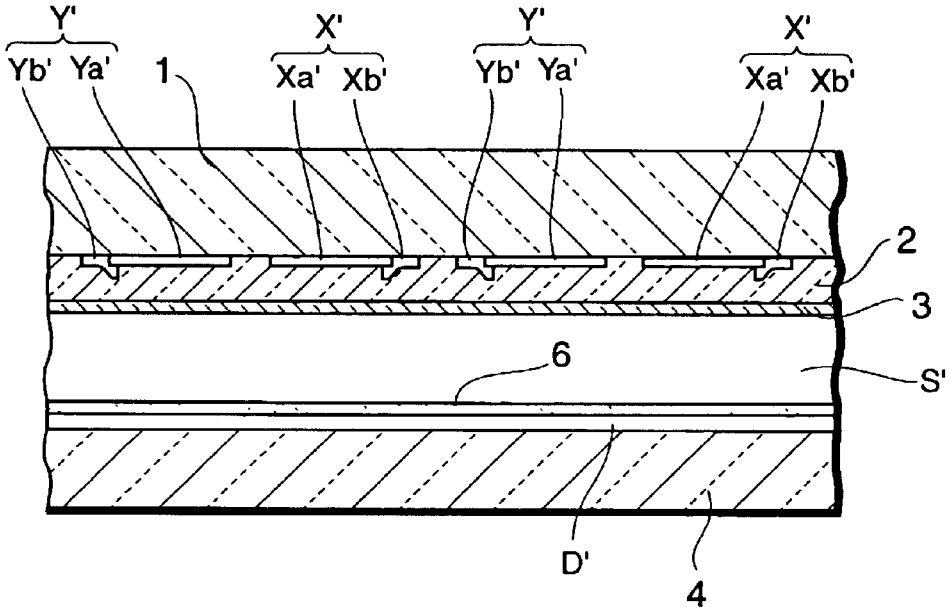
FIG.7 PRIOR ART
FIG. 7 is a sectional view taken along the V—V line of FIG. 6.
Figure 8:
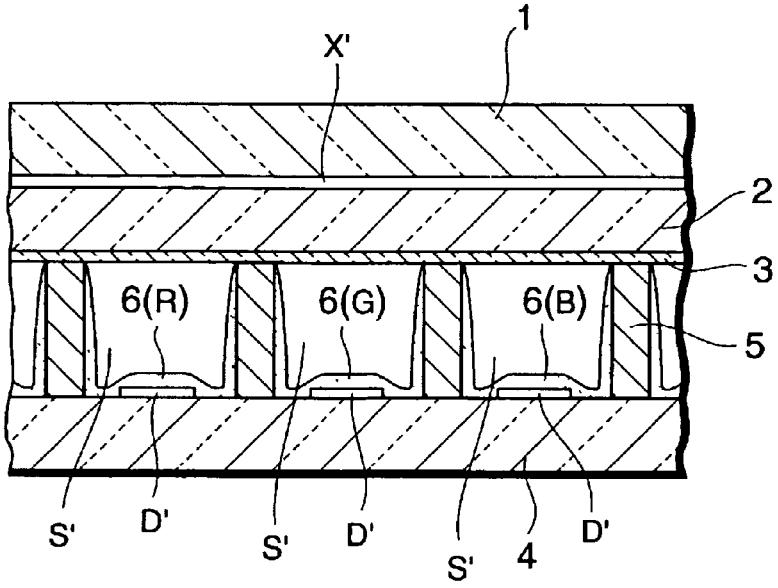
FIG.8 PRIOR ART
FIG. 8 is a sectional view taken along the W—W line of FIG. 6.

FIG. 5 is a sectional side view illustrating a third embodiment of the PDP according to the present invention, which is taken in the same position as that in FIG. 2 of the first embodiment.

The PDP of the third embodiment includes a recessed groove h2 which is formed in a portion of the back surface of a front glass substrate 30 which is opposite to back-to-back positioned transverse walls 15*b* of the adjacent partition walls 15 and the interstice SL between the back-to-back transverse walls 15*b*, by use of sandblast techniques as in the case in the second embodiment and extends in a band form in the row direction. The recessed groove h2 has side walls formed by indenting the front glass substrate 30 in a wedge-like form to form a trapezoid-shaped cross section of the groove h2.

Each of bus electrodes X2*b*, Y2*b* of row electrodes X2, Y2 is formed to extend along an inner side face of the recessed groove h2 which is slanted by indenting the front glass substrate 30 in the wedge-like form, so that the spacing between the back-to-back bus electrodes X2*b* and Y2*b* within the recessed groove h2 increases gradually toward the front surface of the front glass substrate 30 (in a direction of the top of FIG. 5).

Other configuration of the PDP in the third embodiment is approximately the same as that in the first embodiment, and the same reference numerals as those in the first embodiment are used in FIG. 5.

With the PDP of the third embodiment, the spacing between the bus electrodes X2*b*, Y2*b* within the recessed groove h2 is increased much more than that in the second embodiment. Hence, occurrence of an opposite discharge in the sustaining discharge is prevented at a higher degree. Additionally, capacitance between the bus electrodes X2*b* and Y2*b* is also decreased much more, leading to more effective prevention of unnecessary power consumption.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a pair of substrates opposite each other with an interposed discharge space, a plurality of row electrode pairs provided on an inner surface of one substrate of the pair of the substrates, arranged in a column direction and each extending in a row direction to form a display line, a dielectric layer covering the row electrode pairs on the inner surface of the one substrate, and a plurality of column electrodes provided on a surface of the other substrate facing the one substrate, arranged in the row direction, and each extending in the column direction to intersect the row electrode pairs and form unit light-emitting areas in the discharge space at the respective intersections, said plasma display panel comprises:

a recess provided in a portion of the inner surface of said one substrate facing a non-display area between the adjacent unit light-emitting areas in the column direction, wherein each of row electrodes constituting said row electrode pair comprises an edge portion, and the adjacent edge portions of the respective row electrodes positioned back to back in between the adjacent row electrode pairs respectively extend along both side faces of each of said recesses, formed in the one substrate, in a direction of raising the edge portions in relation to other portions of the respective row electrodes concerned in a thickness direction of the one substrate.

2. A plasma display panel according to claim 1, wherein each of the row electrodes constituting each of said row electrode pairs comprises an electrode body extending in the row direction and forming said edge portion, and transparent electrodes each extending from the electrode body in the column direction to face the other row electrode of the paired row electrodes with an interposed discharge gap, and the electrode body extends along one of the both side faces of said recess in a direction of raising the electrode body in relation to the corresponding transparent electrode in a thickness direction of said one substrate.

3. A plasma display panel according to claim 1, further comprising a middle layer provided on a portion of the inner surface of said one substrate facing each of the unit light-emitting areas to be interposed between the one substrate and the dielectric layer, each of said recesses being configured by a space between the middle layers adjacent to each other in the column direction, and each of said row electrode pairs being formed on the middle layer.

4. A plasma display panel according to claim 1, wherein said recess is formed by partially cutting a portion of the inner surface of said one substrate.

5. A plasma display panel according to claim 1, wherein the both side faces of said recess extend in a direction approximately perpendicular to said one substrate.

6. A plasma display panel according to claim 1, wherein the side faces of he both sides of said recess respectively extend along indented faces of the one substrate in a wedge-like form.

* * * * *